United States Patent [19]

Smith

[11] Patent Number: 4,815,305

[45] Date of Patent: Mar. 28, 1989

[54] AUXILIARY SAFETY CHAIN LOCK

[76] Inventor: William C. Smith, 25701 W. 12 Mile Rd., Apt. #402, Southfield, Mich. 48034

[21] Appl. No.: 73,502

[22] Filed: Jul. 15, 1987

[51] Int. Cl.[4] ..... E05B 65/06

[52] U.S. Cl. ..... 70/93; 292/264

[58] Field of Search ..... 292/264, DIG. 53, DIG. 60, 292/340, 266; 70/93, 461

[56] References Cited

U.S. PATENT DOCUMENTS

| | | | |
|---|---|---|---|
| 1,612,728 | 12/1926 | Johanning | 70/93 |
| 2,966,053 | 12/1960 | Mintz | 70/93 |
| 2,995,919 | 8/1961 | Davis | 70/93 |
| 3,071,958 | 1/1963 | Russo | 70/93 |
| 3,101,603 | 8/1963 | North et al. | 70/93 |
| 3,125,875 | 3/1964 | Friedman | 70/93 |
| 3,134,252 | 5/1964 | Mintz | 70/93 |
| 3,161,035 | 12/1964 | Adamec et al. | 70/93 |
| 3,275,364 | 9/1966 | Quinn | 292/264 |
| 3,395,556 | 8/1968 | Waldo | 70/93 |
| 3,657,908 | 4/1972 | Schwartz et al. | 70/93 |
| 3,667,794 | 6/1972 | Lentz, Jr. | 70/93 X |
| 3,705,504 | 12/1972 | Johnson | 70/93 |
| 3,762,752 | 10/1973 | Saunders | 292/264 |
| 3,763,673 | 10/1973 | Colombo et al. | 70/93 |
| 3,788,107 | 1/1974 | Lippman | 70/93 |
| 4,017,104 | 4/1977 | Walker | 70/93 X |
| 4,027,908 | 6/1977 | Crepinsek | 70/93 X |
| 4,106,800 | 8/1978 | Nakanishi | 292/264 |
| 4,192,537 | 3/1980 | Laine | 292/264 |
| 4,472,143 | 8/1984 | Bennett et al. | 70/93 X |

FOREIGN PATENT DOCUMENTS

| | | | |
|---|---|---|---|
| 22135 | 11/1911 | United Kingdom | 292/264 |
| 21844 | 3/1913 | United Kingdom | 292/264 |

*Primary Examiner*—Robert L. Wolfe
*Assistant Examiner*—Suzanne L. Dino
*Attorney, Agent, or Firm*—Harness, Dickey & Pierce

[57] ABSTRACT

A portable lock mechanism to secure safety chain latch devices is disclosed. The lock device includes a locking mechanism having a member coupled therewith which is adapted to be coupled with a safety chain latch slide plate. Also, a mechanism to retain the safety chain is coupled with the locking mechanism. The retaining member is coupled with the locking mechanism such that in a first position the safety chain is removably coupled with the retaining member which, in turn, is unlocked with the locking mechanism and in a second position the safety chain is nonremovably coupled with the retaining member which, in turn, is locked with the locking mechanism.

21 Claims, 2 Drawing Sheets

AUXILIARY SAFETY CHAIN LOCK

BACKGROUND AND SUMMARY OF THE INVENTION

The present invention relates to locking devices and, more particularly, to portable auxiliary locking devices to lockably secure safety chain latches.

When traveling or vacationing, the traveler or vacationer generally encounters the dilemma of leaving his hotel room with his hotel room door locked with just the issued hotel key. Several hotel personnel may have access to keys that enable entrance, authorized or unauthorized, to the hotel room along with the traveler. Also, it is possible for others, such as thieves or the like, to obtain master keys to procure unauthorized entrance into the traveler's hotel room.

Generally in hotel rooms, there is a secondary door lock of the safety chain variety. However, these locks are ordinarily securable only when the traveler is present in his room. Locks do exist that lockably secure safety chain latch devises, however, these locks are permanent or non-universal to adapt to the safety chain device. Relevant art devices for locking safety chain latches are illustrated in the following patents. The relevant art patents are U.S. Pat. Nos. 2,995,919; 3,125,875; 3,134,252; 4,192,537; and British Pat. Nos. 22,135 and 21,844.

While the above patents illustrate safety chain latch locking devices, they have several disadvantages. One disadvantage is that the locking mechanism is permanently secured to the door or jamb and the traveler would be issued a key from the hotel establishment and thus, the traveler would have the same problems as explained above. Another disadvantage is that some of the above patents require special attachments to secure the locks to conventional safety chain latch mechanisms.

Accordingly, it is an object of the present invention to overcome the disadvantages of the above art. The lock of the present invention provides the art with a portable auxiliary lock for safety chain latches. The present invention is ordinarily easily coupled with the slide plates of safety chain latch devices. The present invention also enables easy accommodation of the safety chain latch bolts. The present invention is compact and easily carried by the traveler. Further, the present invention enables the traveler to have his own personal lock and key to lock his hotel room, eliminating unauthorized entrance into his room by others that may have keys to the hotel room door.

The present invention provides the art with a new and improved portable auxiliary lock for safety chain latches. The lock of the present invention includes a locking mechanism having a key and tumbler mechanism to enable locking of the device. A mechanism is coupled with the locking mechanism and is adapted to be coupled with a safety chain latch slide plate. Further, a mechanism for retaining a safety chain latch bolt is associated with the locking mechanism. The retaining mechanism is coupled with the locking mechanism such that in a first position the latch bolt is removably coupled with the retaining mechanism which, in turn, is unlocked with the locking mechanism and in a second position the latch bolt is non-removably coupled with the retaining mechanism which, in turn, is locked with the locking mechanism.

Generally, the locking mechanism includes a housing a portion of which is formed to enable the housing to be positioned about the safety chain slide plates. Also, the retaining mechanism is slideably coupled with the locking mechanism for movement between the first and second positions and has a receiver or the like to receive safety chain latch bolts.

From the subsequent description and the appended claims taken in conjunction with the accompanying drawings, additional objects and advantages of the present invention will become apparent to one skilled in the art.

BRIEF DESCRIPTION OF THE DRAWINGS

FIG. 1 is a perspective view of a lock in accordance with the present invention secured to a door or the like.

DETAILED DESCRIPTION OF THE PREFERRED EMBODIMENT

Figure 1:
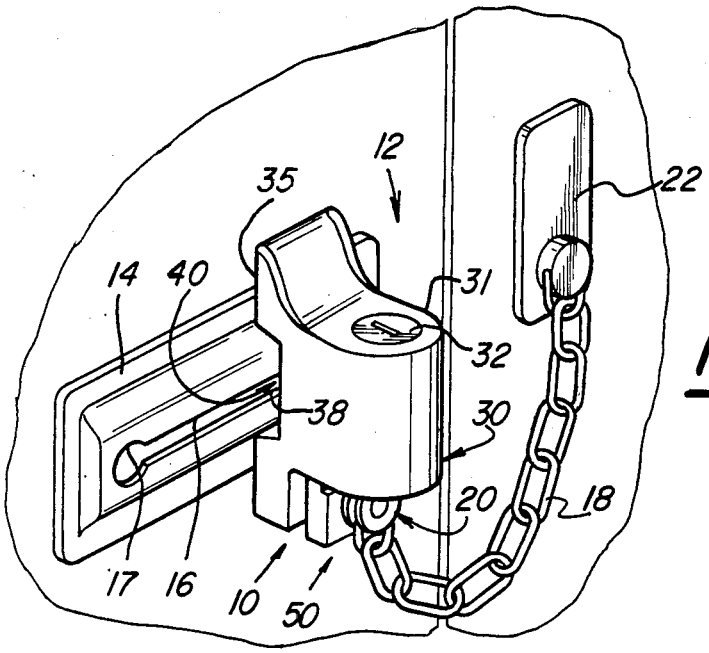

Turning to the figures, a portable lock mechanism to secure safety chain latch devices is shown and designated with reference numeral 10. Particularly in FIG. 1, the lock mechanism 10 is illustrated with a conventional safety chain latch device 12. The safety chain latch device 12 includes an elongated slide plate 14 with a longitudinal slot 16 to which the lock mechanism 10 is coupled. The chain 18 has a latch bolt 20 secured at one end and has a mechanism 22 to secure the chain to a door, the jamb, or the like. The slide plate 14 also is secured to the door, the jamb, or the like such that when the slide plate 14 is secured to the door, the chain securement mechanism 22 is secured to the jamb and vice versa.

Figure 2:
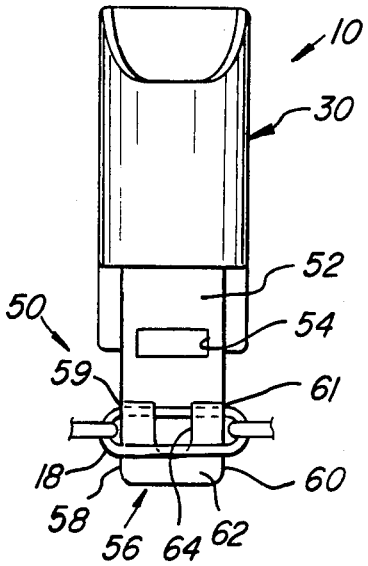
FIG. 2 is a front elevation view of the lock of the present invention.
Figure 3:
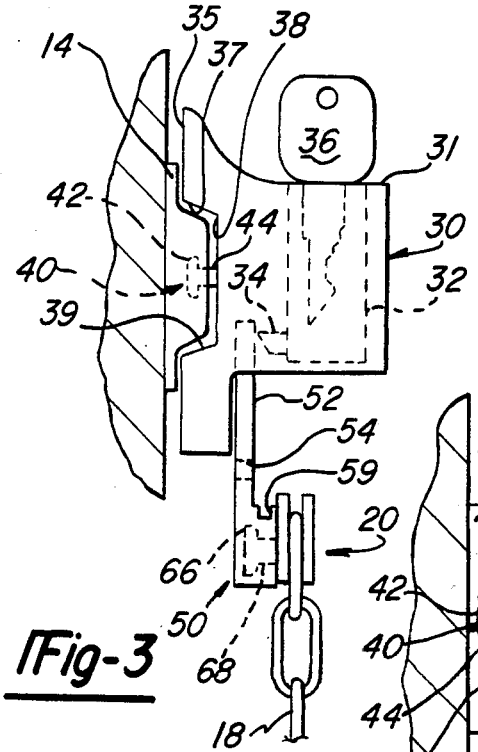
FIG. 3 is a side elevation view of the lock in accordance with the present invention in an unsecured position.
Figure 4:
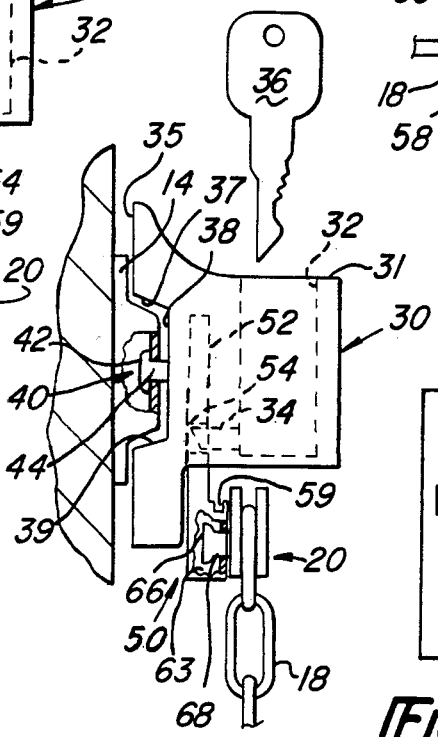
FIG. 4 is similar to FIG. 3 partially in cross-section with the lock in a secured position.

Moving to FIGS. 2 through 4, a better understanding of the lock mechanism 10 may be procured. The lock mechanism 10 generally includes a housing 30, a mechanism 40 for securing the housing to a slide plate 14 and a mechanism 50 for securing the latch bolt 20. The housing 30 includes a cylindrical portion 31 which contains lock tumblers 32 and a locking bolt 34. The tumblers 32 and locking bolt 34 are actuated by a key 36 and operate in a conventional fashion. The key 36 is inserted into the tumblers, turned in either direction which, in turn, moves the lock bolt 34 in and out of a locking engagement. The housing 30 also includes a back 35 having a cutout portion 38. The cutout portion 38 enables the housing 30 to be positioned about the slide plate 14. A pair of angle walls 37 and 39 on the back 35 are positioned along the longitudinal sides of the cutout portion 38 to enhance the securement of the housing 30 around the slide plate 14.

A bolt mechanism 40, similar to the latch bolt 20, is secured to the housing cutout portion 38 to secure the lock mechanism 10 in the side plate slot 16. The bolt 40 generally has a head portion 42 and a neck portion 44. The head portion 42 is enlarged and fits through the slot enlarged portion 17 to secure the neck 44 within the slide plate slot 16.

A latch bolt retaining member 50 is slideably positioned within the housing 30. The retainer 50 may be removable from the housing 30 or may be permanently secured within the housing 30.

The latch bolt retainer 50 includes an elongated wall member 52 which slides within the housing 30. A channel 54 is cut into the wall member 52 to enable the lock bolt 34 to lock the retainer wall member 52 in the housing 30. The retainer 50 includes a pocket 56 which retains the latch bolt 20 onto the retainer 50. The pocket 56 includes a pair of wall members 58 and 60 integral with and projecting perpendicular from the wall member 52. Also, a third wall member 62 is positioned between and integral with the side walls 58 and 60 and is parallel with the wall member 52 thus forming a hollow cavity 63 between the wall members 52, 58, 60 and 62. The wall member 62 has a slot 64 therein to enable the latch bolt 20 to be retained within the slot 64. Generally, the head 66 of the latch bolt 20 is positioned within the pocket cavity 63 having its neck 68 nesting and retained in the slot 64. Also, slots 59 and 61 may be formed in wall members 58 and 60 to retain a link of chain 18 as seen in FIG. 2. The link is retained in the housing 30 by retainer 50 as described herein.

As seen in FIGS. 3 and 4, the wall member 52 moves from a first position to a second position wherein the lock bolt 34 projects into the channel 54 locking the retainer 50 in the housing 30. In the locked position, FIG. 4, the lock bolt 20 is nonremovable and lockably secured in the retainer 50 which, in turn, is locked by the locking bolt 34 in the housing 30 and the housing 30 is secured to the slide plate 14, via the bolt mechanism 40. Also, when a chain link is secured in the retainer 50 the chain link would be nonremovable and lockably secured in the retainer 50 against the housing 30. Thus, a traveler can lock his own room with his own portable lock to prevent unauthorized entry to his room by intruders.

Figure 5:
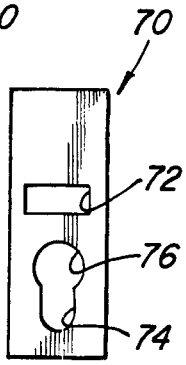
FIG. 5 is a front elevation view of a second embodiment of the present invention.
Figure 5A:
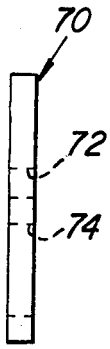
FIG. 5*a* is a side elevation view of FIG. 5.

FIGS. 5 and 5*a* illustrate a second embodiment of a retainer in accordance with the present invention. The retainer 70, generally an elongated rectangular member, includes a pair of apertures 72 and 74. Aperture 72 is generally rectangular, however it could be any shape, to enable passage of the lock bolt 34 therethrough to lock the retaining member 70 in the housing 30. The aperture 74 has an enlarged portion 76 to enable passage of the latch bolt head 66 therethrough and enable the neck 68 to be retained in the slot 74. The retainer 70 is slideably moved in the housing 30 to lockably secure the latch bolt 20 in the housing 30 as explained above.

Figure 6:
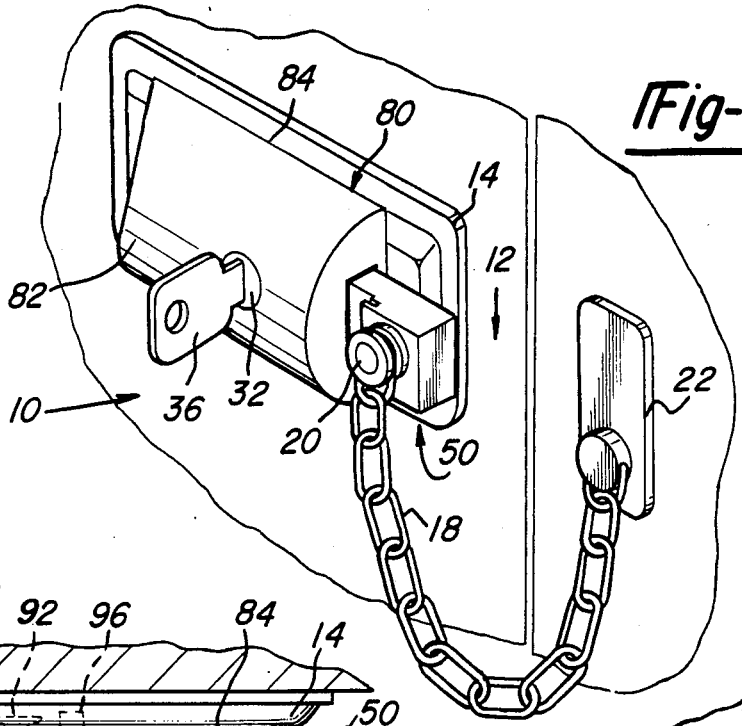
FIG. 6 is a perspective view of another embodiment of an auxiliary safety chain lock in accordance with the present invention.

FIG. 6 illustrates a second embodiment of the present invention. The lock mechanism 10 has its longitudinal axis positioned substantially parallel to the longitudinal axis of the slide plate 14. The safety chain latch device 12 is substantially similar to that previously described and is identified with the same reference numerals.

Figure 7:
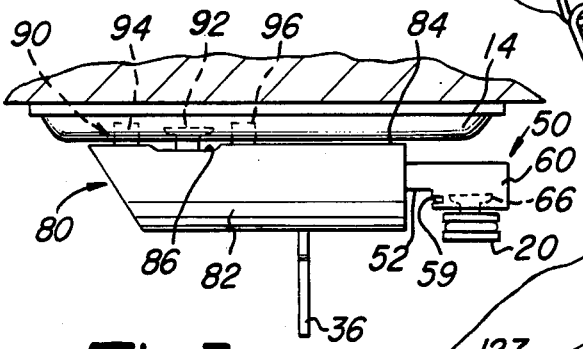
FIG. 7 is a top plan view of FIG. 6.

The lock mechanism 10 generally includes an elongated housing 80, a mechanism 90 for securing the housing to a slide plate 14, and a mechanism 50 to secure the safety chain latch bolt 20 with the lock mechanism 10. The elongated housing 80 includes an arcuate surface 82. A key 36 is coupled with the tumbler 32 on the arcuate surface 82 to activate the locking mechanism 10 as explained herein. The elongated housing 80 has a back 84 which may or may not include a cutout portion 86 as seen in FIG. 7. Preferably, the back 84 is substantially planar and abuts against the side plate 14.

The mechanism 90 includes a bolt mechanism 92, similar to the latch bolt 20, secured to the back cutout portion 86 of the housing to secure the lock mechanism 10 in the slide plate 14. A pair of prongs 94 and 96 are substantially colinear to the bolt 92 and are positionable into the slide plate slot. The prongs 94 and 96 enhance the securement of the elongated housing 80 in the slide plate 14 as shown in FIG. 6.

Latch bolt retaining member 50 is substantially the same as herein described. Thus, the latch bolt member will not be described, however, the reference numerals which relate to the previously described elements will be designated.

Figure 8:
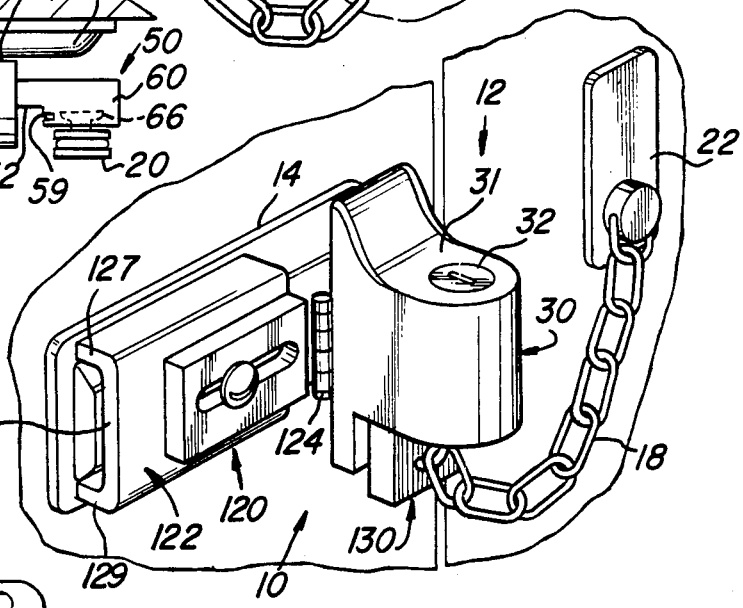
FIG. 8 is a perspective view of another embodiment of an auxiliary lock in accordance with the present invention.
Figure 9:
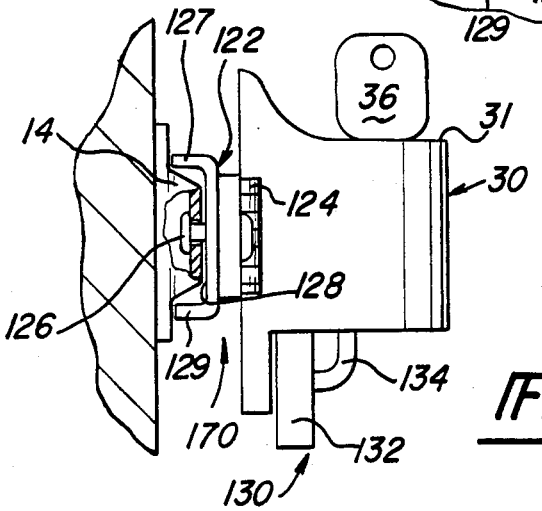
FIG. 9 is a partial cross-section side elevation view of FIG. 8.

FIGS. 8 and 9 illustrate another embodiment of the present invention. FIG. 8 illustrates a perspective view of the invention. The lock mechanism 10 includes a housing 30, a mechanism 120 for securing the housing to a slide plate 14 and a mechanism 130 for securing the safety chain 18. The housing 30 is similar to the housing 30 of FIG. 1 and like components will be designated with the same reference numerals.

The mechanism 120 for securing the housing to the slide plate 14 includes a guide 122 having a U-shape in cross-section. The guide 122 is secured to the housing by a hinge 124. The hinge enables the guide 122 to be pivoted about the housing. This pivoting action further enables the lock mechanism 10 to be secured to various types of safety chain latch devices 12.

A bolt mechanism 126, similar to the latch bolt 20, is secured to the base 128 of the U-shaped guide 122. The bolt 126 enables the guide 122 to be secured within the slot 16 of the slide plate 14. Walls 127 and 129 project from the base 128 to enable the guide 122 to be positioned about the slide plate 14.

The retaining member 130 is similar to the retaining member 50. The retaining member 130 includes a wall member 132 which slides within the housing 30. Also, the retaining member 130 includes a hook 134 to secure links of the chain 18 in the retaining member 130. The previously illustrated retaining members 50 and 70 may be modified to include the present hook on an exterior wall. The hook 134 contacts the bottom of the housing so that the chain link is nonremovably coupled with the locking mechanism 10. Further, a recess may be positioned in the bottom of the housing to receive the top of the hook 134 to further enhance the locking of chain links onto the hook 134.

While the above summarizes the detailed description of the preferred embodiment, it will become apparent to those skilled in the art that alterations, variations, and modifications may be made to the present invention without deviating from the scope and fair meaning of the subjoined claims.

What is claimed is:

1. A portable lock for a safety chain latch comprising:

locking means;

means adapted for removably coupling said locking means with a safety chain latch slide plate means, said coupling means coupled with said locking means; and means for retaining a safety chain, said retaining means coupled with said locking means such that in a first position said safety chain is removably coupled with said retaining means, in said first position said retaining means being unlocked with said locking means, and in a second position said safety chain is non-removably coupled with said retaining means, in said second position said retaining means being locked with said locking means.

2. The portable auxiliary safety chain lock according to claim 1 wherein said locking means comprises a housing, said housing including a cutout portion for enabling said housing to be positioned about said slide plate means, and a key for moving a lock bolt from a locked to an unlocked position wherein said retaining means is locked and unlocked, respectively, by said lock bolt.

3. The portable auxiliary safety chain lock according to claim 1 wherein said locking means comprises a housing, said housing having an arcuate wall and a substantially planar wall, a key for moving a lock bolt from a locked to an unlocked position wherein said retaining means is locked and unlocked, respectively, by said lock bolt.

4. The portable auxiliary safety chain lock according to claim 3 wherein said means for coupling said locking means with said slide plate includes a bolt member and at least one prong both positioned on said planar back of said housing for positioning said housing longitudinally with said safety chain slide plate means.

5. The portable auxiliary safety chain lock according to claim 2 wherein said means to be coupled with said slide plate means is positioned on said cutout portion of said housing.

6. The portable auxiliary safety chain lock according to claim 1 wherein said retaining means comprises a wall member slideably coupled with said locking means for movement between said first and second position, and said wall member including means for receiving said safety chain.

7. The portable auxiliary safety chain lock according to claim 1 wherein said lock means includes a housing, said housing including a key for moving a lock bolt from a locked to an unlocked position wherein said retaining means is locked and unlocked, respectively, by said lock bolt, and a guide member pivotably coupled with said housing, said guide member including said means for coupling said housing to said safety chain latch slide plate means.

8. A portable lock for a safety chain comprising:

a lock mechanism including means for positioning the lock mechanism about slide plate means of safety chain latch devices, means for removably coupling said lock mechanism with said slide plate means, said coupling means coupled with said lock mechanism; and means for retaining said safety chains said retaining means including a wall member slideable in said lock mechanism such that in a first position said safety chain is removably coupled with said wall member which, in turn, is unlocked with said locking mechanism and in a second position is non-removably coupled with said wall member which, in turn, is locked with said lock mechanism.

9. The portable lock according to claim 8 wherein said locking means comprises a housing, said housing having an arcuate wall and a substantially planar wall, a key for moving a lock bolt from a locked to an unlocked position wherein said retaining means is locked and unlocked, respectively, by said lock bolt.

10. The portable lock according to claim 9 wherein said means for coupling said locking means with said slide plate includes a bolt member and at least one prong both positioned on the planar back of said housing for positioning said housing longitudinally with said safety chain slide plate means.

11. The portable lock according to claim 8 wherein said lock mechanism comprises a housing, said housing including a cutout portion for enabling said housing to be positioned about said slide plate means, and a key for moving a lock bolt from a locked to an unlocked position wherein said wall member is locked and unlocked, respectively, by said lock bolt.

12. The portable lock according to claim 11 wherein said means to be coupled with said slide plate means is positioned on said cutout portion of said housing.

13. The portable lock according to claim 8 wherein said wall member includes means for receiving said safety chain.

14. The portable lock according to claim 8 wherein said lock means includes a housing, said housing including a key for moving a lock bolt from a locked to an unlocked position wherein said retaining means is locked and unlocked, respectively, by said lock bolt, and a guide member pivotably coupled with said housing, said guide member including said means for coupling said housing to said safety chain latch slide plate.

15. A safety chain latch comprising:

slide plate means including a slot securable to a door, door jamb, or the like;

a safety chain having two ends and including a latch bolt means secured at one end and a means for securing the safety chain to a door, door jamb, or the like, secured at the other end thereof;

locking means;

means adapted for removably coupling said locking means with said slot of said slide plate means, said coupling means coupled with said locking means; and means for retaining said latch bolt means, said retaining means secured by said locking means such that in a first position said bolt means is removably coupled with said retaining means which, in turn, is unlocked with said locking means and in a second position is non-removably coupled with said retaining means which, in turn, is locked with said locking means.

16. The safety chain latch according to claim 15 wherein said locking means comprises a housing, said housing including a cutout portion for enabling said housing to be positioned about said slide plate means, and a key for moving a lock bolt from a locked to an unlocked position wherein said retaining means is locked and unlocked, respectively, by said lock bolt.

17. The safety chain latch according to claim 15 wherein said locking means comprises a housing, said housing having an arcuate wall and a substantially planar wall, a key for moving a lock bolt from a locked to an unlocked position wherein said retaining means is locked and unlocked, respectively, by said lock bolt.

18. The safety chain latch according to claim 17 wherein said means for coupling said locking means with said slide plate includes a bolt member and at least one prong both positioned on the planar back of said housing for positioning said housing longitudinally with said slide plate means.

19. The safety chain latch according to claim 16 wherein said means to be coupled with said slide plate means is positioned on said cutout portion of said housing.

20. The safety chain latch according to claim 15 wherein said retaining means comprises a wall member slideable in said locking means for movement between said first and second position, and said wall member including means for receiving said safety chain.

21. The safety chain latch according to claim 15 wherein said lock means includes a housing, said housing including a key for moving a lock bolt from a locked to an unlocked position wherein said retaining means is locked and unlocked, respectively, by said lock bolt, and a guide member pivotably coupled with said housing, said guide member including said means for coupling said housing to said slide plate means.

* * * * *